US006106016A

United States Patent [19]

Bette

[11] Patent Number: 6,106,016

[45] Date of Patent: Aug. 22, 2000

[54] CHEST MOUNTED BOOK HOLDER

[76] Inventor: James R Bette, 17935 Rosita St., Encino, Calif. 91316

[21] Appl. No.: 09/324,787

[22] Filed: Jun. 3, 1999

[51] Int. Cl.[7] ..... B42D 17/00

[52] U.S. Cl. ..... 281/45; 248/42; 248/43; 248/51; 281/441.1; 281/444; 281/451; 281/455

[58] Field of Search ..... 281/42, 43, 45, 281/51; 248/441.1, 444, 451, 455, 454

[56] References Cited

U.S. PATENT DOCUMENTS

| | | | |
|---|---|---|---|
| 869,918 | 11/1907 | Lipscond | 248/444 |
| 1,035,290 | 8/1912 | Wood | 248/444 |
| 1,232,089 | 7/1917 | Riebe | 108/43 |
| 2,481,107 | 9/1949 | Gore | 248/444 |
| 5,860,769 | 1/1999 | Seligman | 405/186 |

*Primary Examiner*—Daniel W. Howell
*Assistant Examiner*—Monica Carter

[57] ABSTRACT

A chest mounted book holder for carrying a field guide or other reading matter while hiking or observing nature attached to the chest area of an outer garment or to an adjustable upper body harness. The book holder includes page holders for holding the book open at a desired page and protects the pages from turning in the wind and is equipped with side stops so the book cannot fall out. Adjusting straps allow the book to be positioned at a comfortable distance and angle from the reader and can be folded and secured against the chest when not in use. The user is able to turn the pages of a book when the book holder is in an open position and to make notes on the book or adjacent to it.

2 Claims, 5 Drawing Sheets

CHEST MOUNTED BOOK HOLDER

CROSS-REFERENCE TO RELATED APPLICATIONS

Not Applicable

STATEMENT REGARDING FEDERALLY SPONSORED RESEARCH OF DEVELOPMENT

Not Applicable

REFERENCE TO A MICROFICHE APPENDIX

Not Applicable

BACKGROUND OF THE INVENTION

Nature lovers and in particular bird watchers take joy in hiking through the countryside at different times of the year to identify and sometimes photograph indigenous as well as migrating birds. On rare occasions strays from foreign lands will become lost and appear where they have never been observed before causing much excitement and interest from local birding organizations. Indeed, many birding enthusiasts keep different lists of birds such as those seen this year, those seen in this state and those seen in this lifetime (life list), to name a few.

To facilitate this hobby bird watchers equip themselves with a variety of aides to make the identification process quick and accurate since birds seldom pose for long periods in the presence of Man. These aides include binoculars, spotting scopes and tripods and, perhaps most importantly, the field guide. The field guide is a bound book, usually a paperback, containing artists renderings and/or photographs of birds as well as a written description of the animal including its size, and it may contain other information such as a similar species, what its voice may sound like, its winter and summer ranges, its diet, and its habitat. Of particular interest to birders are the illustrations that highlight features that differentiate one species from another by the use of arrows which pinpoint distinguishing characteristics. Also illustrated are the male and female variety when the sexes are differently adorned and their summer/winter as well as immature/adult plumage. Since some groupings of birds are numerous and the distinguishing characteristics very subtle, the hobbyist may refer to the guide many times before a certain identification can be made.

These field guides are carried in large pockets, "fanny packs", shoulder bags or other similar carriers by the hobbyist. Current practice suggests that the hobbyist view the subject for as long as it is in clear view making mental notes of any distinguishing characteristics (field marks) and refer to the field guide only after the bird has flown away. This practice obviously results from the fact that it is impossible to locate and examine a field guide while holding a viewing aide and impractical to put down the viewing aide, retreive the field guide, locate the possible subject for study, retreive the viewing aide and relocate the subject in the viewfinder to make an identification. When a tripod mounted spotting scope is employed, the observer may use his hands to hold the guide and view the subject bird alternately, assuming the bird does not move outside the field of view while the guide is being referred to. Some field guides recommend a thorough study before a trip is undertaken while other hobbyists travel with an associate so that as one member views the animal, the other calls out field marks indicated in the guide.

Other groups of hikers and outdoor trekkers will often embark on long journeys for exercise and the thrill of viewing natures wonderments and pristine vistas. These excursions often include periods of inactivity for the mind such as walking over flat uninterrupted areas or riding in a conveyance such as a boat or ferry. Such periods could be spent reading a book or map or history of the area being explored except for the lack of a convenient device for holding such material while the explorers hands might otherwise be engaged.

Book holding devices are well known in the prior art including the most recently issued U.S. Pat. Nos. 4,739,960; 5,199,680; 5,351,927; 5,377,946; and 5,445,416 to name a few. While these and other book holding devices may be well suited for their intended purpose, none addresses the problems faced by the nature lover and birdwatcher who must refer to a field guide while at the same time focus a viewing aid on minute distinguishing characteristics of a quickly flitting ball of feathers in order to make a positive identification. Accordingly, the following described invention substantially departs from anything mentioned in the prior art and describes a unique apparatus developed for holding a book in an open position while trekking in the field.

BRIEF SUMMARY OF THE INVENTION

This invention relates to a chest mounted book holder that allows the birdwatcher to easily refer to a field guide while keeping the subject animal in view through binoculars or a spotting scope while making an identification. Such a book holder may also be used to hold other reading material such as a map or a novel. Accordingly, several objects and advantages of this invention are:

(a) to increase the enjoyment of nature lovers by providing a means for conveniently carrying a book mounted on the readers chest area so that it may be read "hands free".

(b) to provide a means whereby a birdwatcher may view birds using a viewing aid such as binoculars or a spotting scope and at the same time conveniently refer to a field guide for identification purposes without diverting his full attention to the reference material and thereby lose sight of the subject.

(c) to provide a means whereby a birdwatcher may more conveniently identify birds from a field guide without the need for an associate.

DETAILED DESCRIPTION OF THE INVENTION

Figure 1:
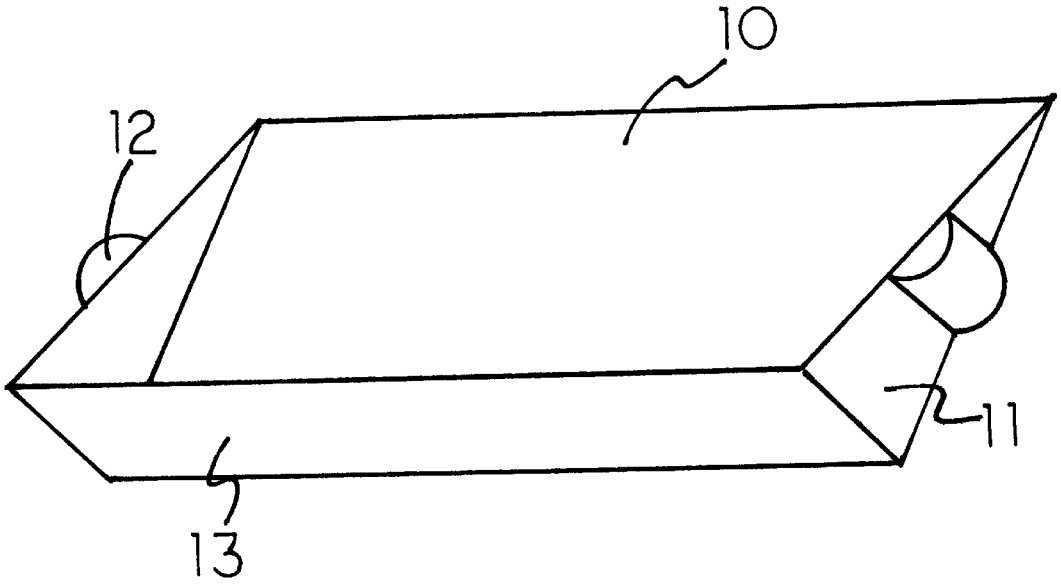
FIG. 1. Book Holder
Figure 2:
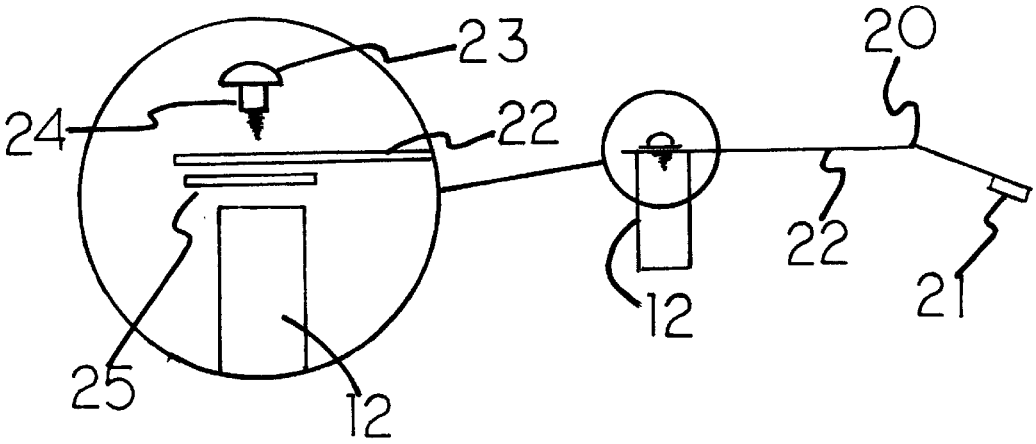
FIG. 2. Page Holder
Figure 3:
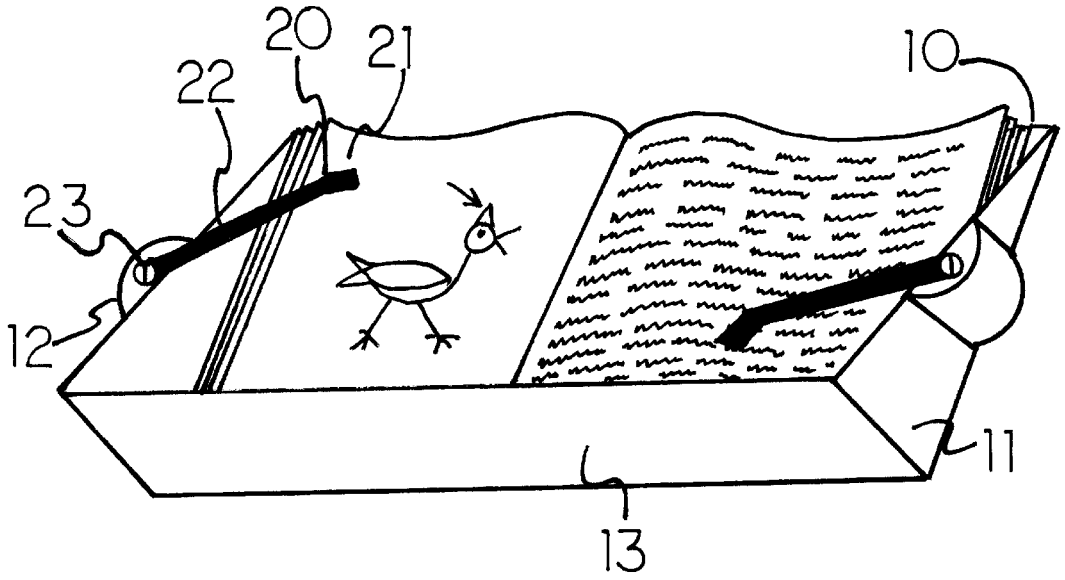
FIG. 3. Book Holder Assembly
Figure 4:
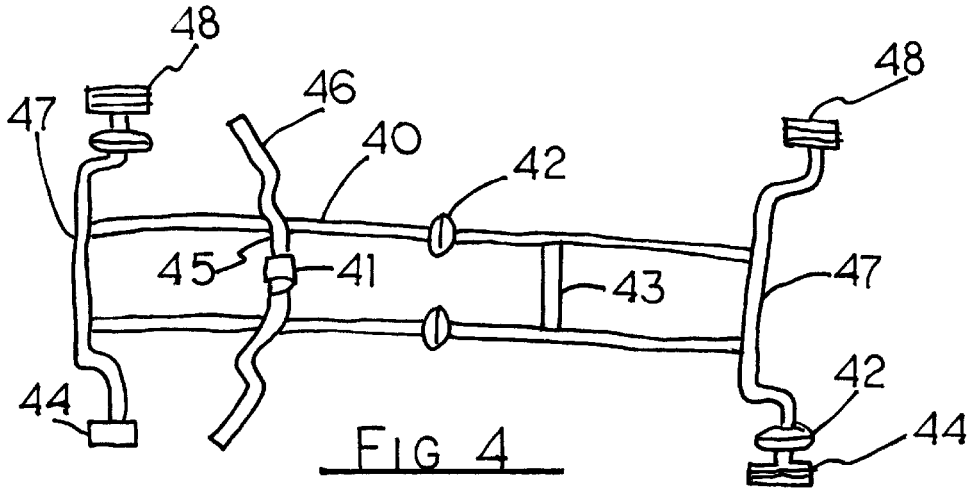
FIG. 4. Chest Harness
Figure 5:
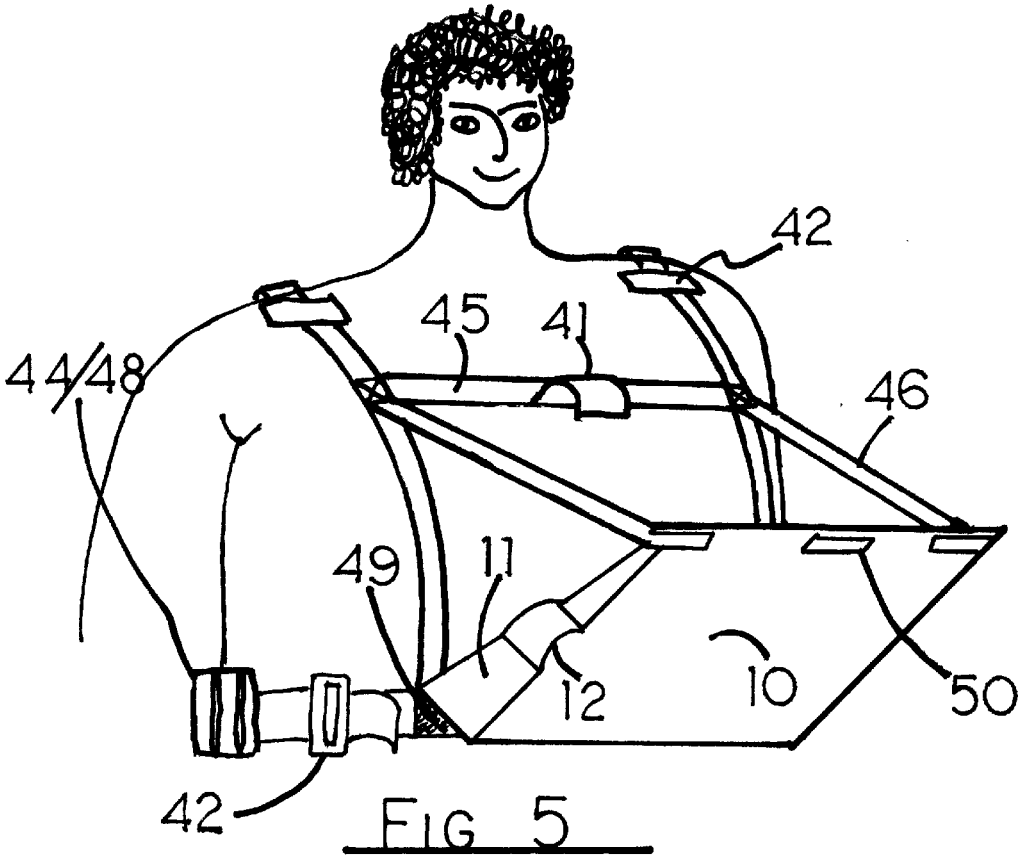
FIG. 5. Book Holder Assembly in Open Position

A typical embodiment of the invention is shown in FIG. 5 and is comprised of the book holder assembly FIG. 3, and the chest harness assembly, FIG. 4. The main components of the book holder assembly is the book holder FIG. 1, and the page holder FIG. 2. In FIG. 1 the back 10 is in a substantially rectangular shape since it will support an open book and is connected to sides 11 and base 13. Since this frame must support an open book it must be made from a rigid material such as wood, metal or thermoplastic synthetic material and molded, glued or welded together. Since it will be carried long distances it should also be light weight and thin. Rectangular base 13 should be wide enough to accommodate a field guide which is also designed to be light weight and is therefore usually a paperback. Sides 11 are tapered from the the full width of base 13 to nothing where it meets the top of back 10 to protect the pages from flapping in the wind as well as forming a stop so the book cannot fall out. Page holder strut 12 is a short semi-circular, solid material such as wood or plastic molded or attached at the midpoint of side 11 giving added bulk at this location in order to receive and hold page holder stud 23 firmly. FIG. 2 shows the page holder assembly which holds the book open at any desired page. Page holder spring 22 is a narrow flat short length of tempered spring steel coil predrilled to accept page holder stud 23 and screwed into page holder strut 12. Although kept securely fastened by page holder stud 23 page holder spring 22 can be easily rotated to any position on the page or can be moved completely off the book since page holder stud 23 has a smooth stud shaft 24 where it engages page holder spring 22 as well as a spacer/washer 25 between it and page holder strut 12 both of which reduce friction when page holder spring 22 is rotated in a lateral direction. At page holder deformation 20 a permanent bend is made in page holder spring 22 giving tension to page holder spring 22 and thereby imparting the ability to hold any book open to any desired page. Page holder tip 21 is a felt disc glued or otherwise fastened to the end of page holder spring 22. When positioned over an open page tension from page holder deformation 20 is transferred to page holder tip 21 holding it open however, pages may still be easily turned by sliding them under the felt page holder tip 21 or by rotating the page holder spring 22 to a position where it doesn't interfere until the desired page is found when page holder spring 22 can be rotated back into a tension position. FIG. 3 depicts the complete book holder assembly in association with an open book.

The chest harness assembly is shown in FIG. 4. The chest harness is a series of straps and belts or webbing made from polypropylene, cotton, nylon or polyester and designed to fit comfortably around the upper body. It consists of two shoulder straps 40 held in position by shoulder strap chest connector 45 in the front and shoulder strap back connector 43 in the rear. They are spaced apart so that the assembly can easily be slipped over the head and rest on the bearers shoulders at the approximate mid point of shoulder strap 40. The front and rear ends of shoulder straps 40 are sewn or glued to belt 47. At the ends of belt 47 is a closure device or buckle. Buckles are available in many shapes and sizes and made from several materials by a large number of suppliers. In this embodiment we have chosen to describe plastic side release buckles 44/48 a common design in outdoor gear, which consists of a male configuration fastened to one end of the belt and an interlocking female counterpart fastened to the other end. When pushed together the buckle snap locks together and can easily be released by pressing the snaps with your fingers disengaging the snaps and separating the two parts. In order to accommodate users of differing girth, adjustment slide 42 is installed in association with either the male or female end of side release buckle 44/48. A slide, also a common feature in outdoor gear and luggage, is a device made of metal or plastic and available from a large number of suppliers. Belt 47 is looped through adjustment slide 42 and then through one side of side release buckle 44/48 and then back through adjustment slide 42. By feeding more or less of the length of belt 47 through adjustment slide 42 the overall length of belt 47 can be increased or reduced. Friction between the two lengths of belt 47 which are held in close proximity to each other as they pass through adjustment slide 42 makes a relatively strong bond since the two sections of belt 47 must travel in different directions before the connection slips. As shown in FIG. 4 the chest harness employs two side release buckles 44/48 in association with two adjustment slides 42 which connect on the sides of the body under the arms. Also, in order to accommodate users of varying heights, another sets of adjustment slides 42 are located midway between shoulder strap connectors 43 and 45 and are located at the top of the shoulders when worn. Similar in all respects to the operation of the belt slides described above, these slides have the effect of increasing or decreasing the distance between the users eyes and the book holder and insure that reading material contained therein can be brought into sharp focus. The ability to adjust the chest harness assembly at the belt and at the shoulder straps not only allows users of different heights and girths to obtain a snug fit, but also allows the device to be worn on the outside of bulky warm outer wear in frigid weather conditions or adjusted for warm weather apparel by the same user.

Figure 6:
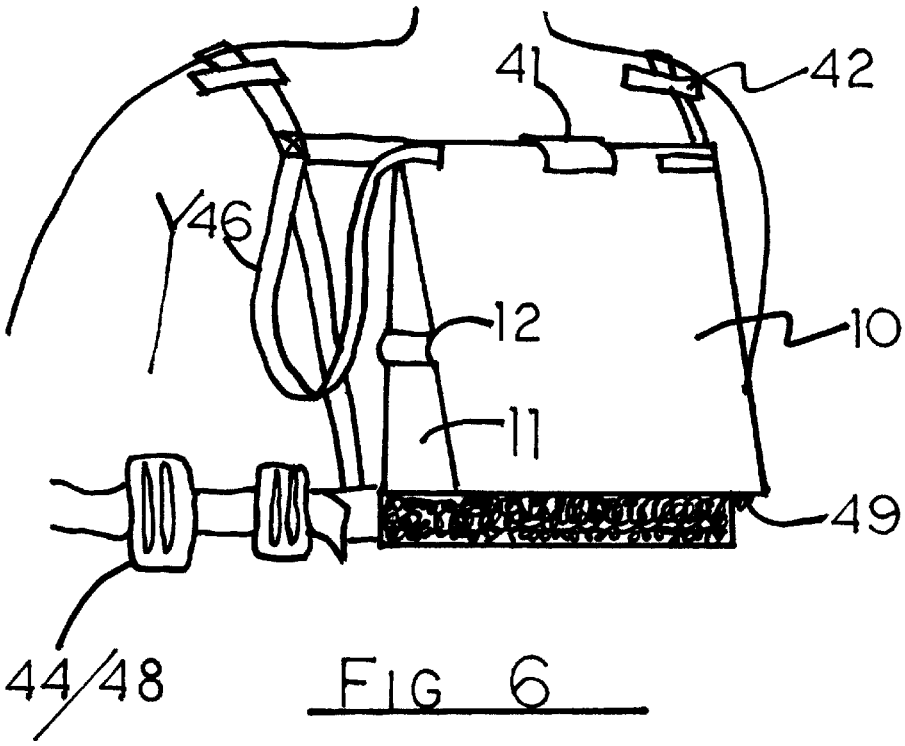
FIG. 6. Book Holder Assembly in Closed Position
Figure 7:
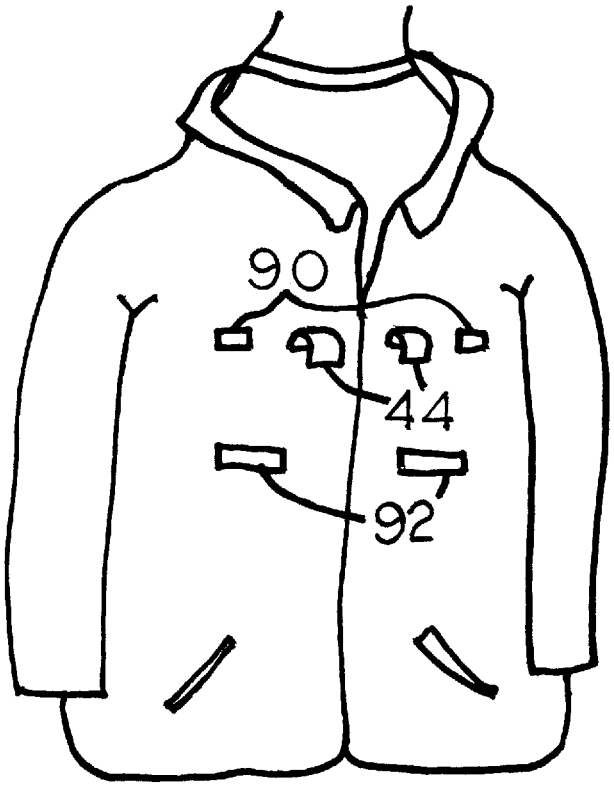
FIG. 7 Garment Mounted Modification
Figure 8:
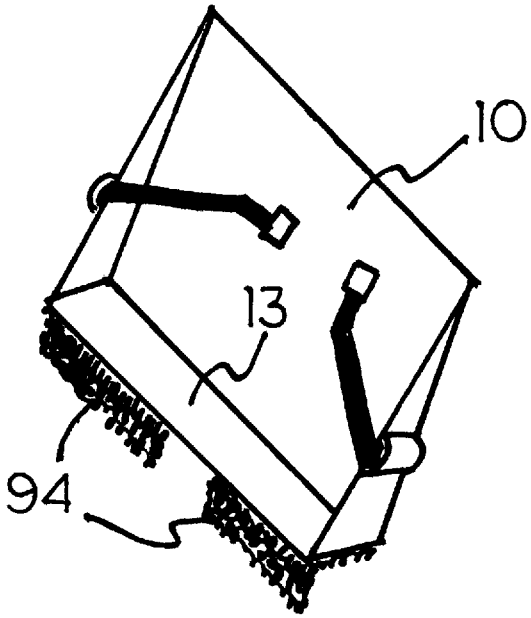
FIG. 8 Garment Mounted Belt Connection
Figure 9:
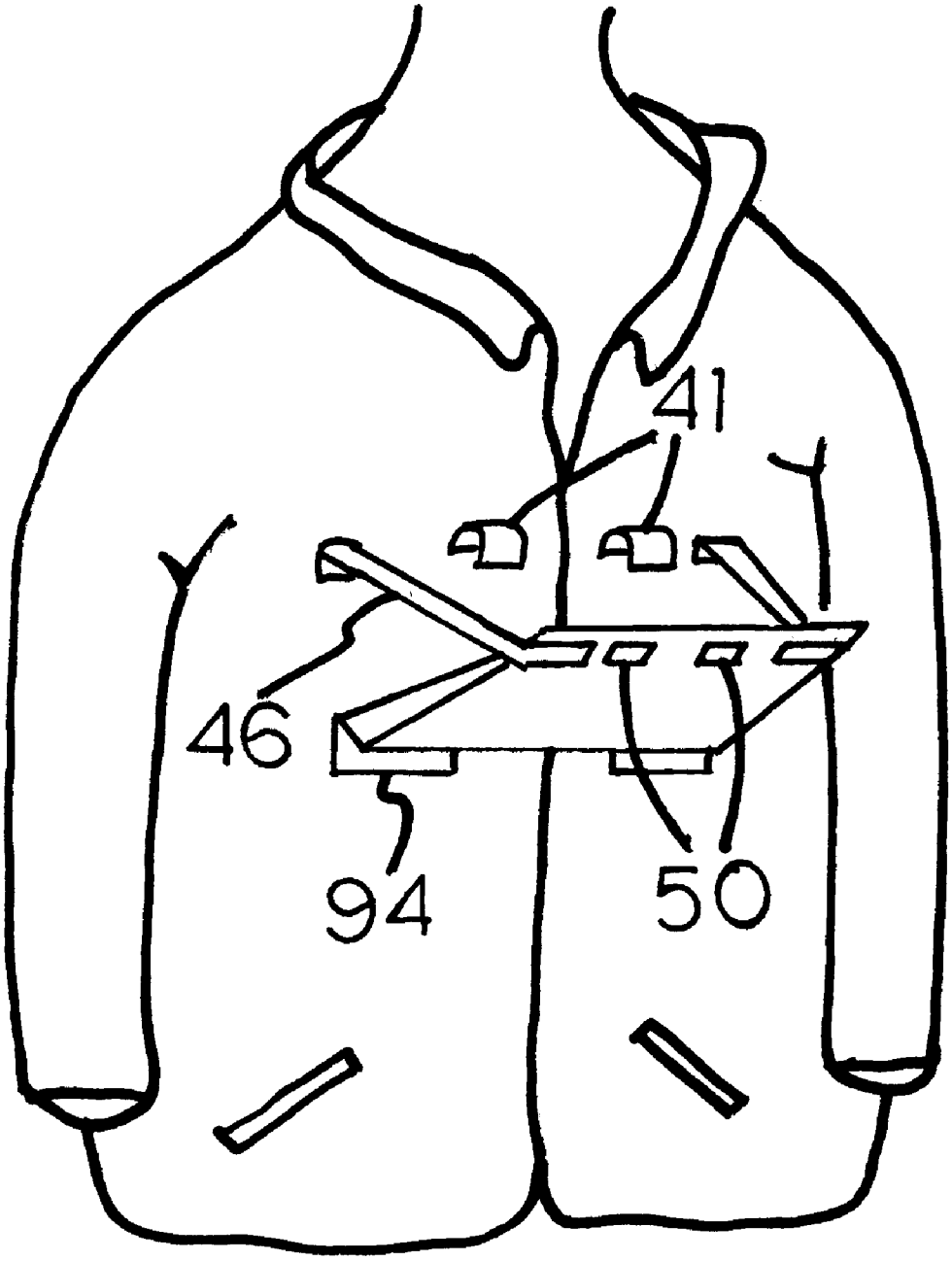
FIG. 9 Garment Mounted Modification Assembly

FIG. 5 shows the attachment of the book holder assembly to the chest harness assembly. Book holder straps 46 are sewn where shoulder straps 40 intersect shoulder strap chest connector 45. The ends of book holder straps 46 are fitted with hook and loop material also known as velcro. This material, available from many suppliers, is comprised of two complimentary connectors, one a series of miniature hooks and the other a series of miniature loops. When pressed together a significant number of hooks intermesh with a number of loops and form a strong connection. The bond can be broken by peeling the two opposing connectors apart without degrading the hook or loop configuration allowing an almost unlimited number of reconnections. By attaching complimentary hook and loop material on the ends of book holder straps 46 and the outside top of book holder back 10 the book holder assembly can be positioned at a comfortable angle to the wearers eyes by increasing or decreasing the distance between the attachment at the chest and the attachment at the book holder by varying the point on the strap that engages its counterpart on the rear of the book holder. Since book holder straps 46 are made from very thin material, a large free area is open beneath it and book holder side 11 when the book holder is in an open position. This allows the wearer to place his hand into this area from either side in order to turn the pages of the book or to make notes on the book itself or on a note pad placed over the book or adjacent to it. FIG. 5 also shows a book holder base/belt connector 49 glued or otherwise attached to base 13 and sewn or otherwise attached to the front of belt 47. This fabric connector joins the book holder assembly and the chest harness assembly and acts as a hinge allowing the book holder assembly to be completely closed flatly against the chest. Book holder closer flap 41 which is made from fabric and sewn at the midpoint of shoulder strap chest connector 45 is also fitted with hook and loop material on the underside where it can engage a complimentary patch fastened at the outside top of book holder back 10 so that when not in use and in the closed position as illustrated in FIG. 6, the book holder assembly forms an almost flat profile against the chest allowing free hand and arm movement in front of the wearer. FIG. 7 shows a variation of the chest harness where a book holder assembly could be mounted directly to the chest area of a garment. Using hook and loop material, a book holder strap connector 90 and a book holder base connector 92 are sewn at appropriate locations at the left and right breast areas of the garment. In order not to interfere with the normally centered closure of a garment (usually a zipper or buttons) the book holder closer flap 41 is also located at he left and right of center. FIG. 8 shows book holder base hinge 94 fastened to the ends of book holder base 13 with the center area free. FIG. 9 shows a completed assembly in an open position with book holder straps 46 fitted with hook and loop material at both ends. This application has the same ability to be closed flatly against the chest as the harness mounted assembly described above. By simply peeling the hook and loop fasteners at the strap and hinge locations and removing the book holder assembly, the garment closer can be operated freely.

When a birdwatcher embarks on a nature walk he would don the shoulder harness over his head and snap lock the buckles, cinching the shoulder and belt slides to obtain a comfortable and snug fit over his upper body garment. He would open the book holder assembly and insert the field guide of his choice perhaps even opening it to a page depicting at least one of the birds he hopes to encounter on this trip, rotating the page holders to hold it open and then close the book holder flat against his chest engaging the book holder flap. When viewing an unidentifiable bird species through his field glasses the operator would then open the book holder and while keeping the bird in view, move his field glasses forward slightly and look down at the field guide. He would then slide the pages under the felt tips of the page holders with one hand while alternately looking through the glasses to keep the quarry in sight. Once he finds what he thinks may be the bird in view, he will study the field guide paying particular attention to the arrows which highlight distinguishing characteristics, alternately viewing the bird and the field guide until a positive identification can be made. Once he has completed the sighting he would then close the book holder again flat against his chest to leave his chest area free for easy hand and arm movement until another identification became necessary.

Accordingly, the reader can see that by using this unique device the process of identifying birds in the wild from a field guide is greatly simplified adding to the enjoyment of the hobby and allowing accurate species verification without the need for a companion. Since the lightweight device is carried on the muscular upper body and can be conveniently folded flat against the chest, it is not a burden to the bearer nor does it interfere with normal hand and arm movements when not in use.

Although the description above contains many specificities, these should not be construed as limiting the scope of the invention but merely providing illustrations of some of the presently preferred embodiments of this invention. Thus the scope of the invention should be determined by the appended claims and their legal equivalents, rather than by the examples given.

What I claim as my invention is:

1. A chest mounted book holder assembly comprising a rectangularly shaped back upon which a book or a field guide is placed and notes written with side covers to protect the pages of the book from being lifted by wind and to stop the book from sliding off the back with means for holding the book open and further means for allowing the pages to be turned when desired while holding them firmly against the wind, further means for collapsing said book holder and folding it against a front torso area of a wearer between a waist and shoulders to secure it against swinging and bounding while walking or hiking and means to unsecure and deploy said book holder for reading, writing, or reference, said book holder being in a generally vertical position when folded and secured against the chest area and a generally horizontal position when opened or deployed, further means for mounting said book holder to the front torso area of the wearer or to the front torso area of an outer garment.

2. A chest mounted book holder assembly as described in claim 1 above with means for adjusting an angle of the book holder to a wearers eyes when in an open or deployed position.

* * * * *